US006742599B1

(12) United States Patent
Nam

(10) Patent No.: US 6,742,599 B1
(45) Date of Patent: Jun. 1, 2004

(54) FIRE EXTINGUISHER

(75) Inventor: Yun-Sang Nam, Seoul (KR)

(73) Assignee: Seog-Beom Kang, Seoul (KR)

( * ) Notice: Subject to any disclaimer, the term of this patent is extended or adjusted under 35 U.S.C. 154(b) by 0 days.

(21) Appl. No.: 10/130,949

(22) PCT Filed: Nov. 25, 2000

(86) PCT No.: PCT/KR00/01356

§ 371 (c)(1),
(2), (4) Date: Sep. 30, 2002

(87) PCT Pub. No.: WO01/37934

PCT Pub. Date: May 31, 2001

(30) Foreign Application Priority Data

Nov. 25, 1999 (KR) ..... 1999-52668

(51) Int. Cl.[7] ..... A62C 11/00

(52) U.S. Cl. ..... 169/30; 169/51; 169/26; 169/29; 169/50; 169/60; 169/89

(58) Field of Search ..... 169/30, 51, 26, 169/29, 56, 60, 19, 21, 74, 71, 75, 76, 89

(56) References Cited

U.S. PATENT DOCUMENTS

| | | | | | |
|---|---|---|---|---|---|
| 591,120 | A | * | 10/1897 | Sherman | 239/587.2 |
| 2,066,290 | A | * | 12/1936 | Hill, Jr. et al. | 169/74 |
| 2,218,189 | A | * | 10/1940 | Allen | 169/30 |
| 2,530,583 | A | * | 11/1950 | Nurkiewicz | 169/75 |
| 2,674,325 | A | * | 4/1954 | Siebens | 169/89 |
| 3,209,949 | A | * | 10/1965 | Gurtler | 169/75 |
| 3,389,753 | A | * | 6/1968 | Howard | 169/30 |
| 3,612,408 | A | * | 10/1971 | Holleman | 239/587.3 |
| 3,671,208 | A | * | 6/1972 | Medsker | 48/180.1 |
| 3,719,231 | A | * | 3/1973 | Haggard | 169/26 |
| 4,020,904 | A | * | 5/1977 | DePalma | 169/74 |
| 4,341,267 | A | * | 7/1982 | Lagasse | 169/54 |
| 4,360,802 | A | * | 11/1982 | Pinto | 169/23 |
| 4,484,710 | A | * | 11/1984 | Roznieck | 239/290 |
| 4,567,948 | A | * | 2/1986 | Roznieck | 169/76 |
| 4,862,968 | A | * | 9/1989 | Woodman | 169/75 |
| 5,472,143 | A | * | 12/1995 | Bartels et al. | 239/462 |

FOREIGN PATENT DOCUMENTS

| | | | |
|---|---|---|---|
| EP | 0792665 B1 | | 2/1997 |
| GB | 2039735 A | | 8/1980 |
| KR | 1997-0003310 | | 4/1997 |
| RU | 2175876 | * | 11/2001 |

* cited by examiner

*Primary Examiner*—Robin O. Evans
(74) *Attorney, Agent, or Firm*—McDermott, Will & Emery

(57) ABSTRACT

A fire extinguisher selectively operable either manually or automatically is disclosed. The fire extinguisher comprises a container (100), a body (200), a discharge nozzle (600), an operating rod assembly (300), and an operating lever (400). The container (100) contains an extinguishing medium (110) under a pressure. The body (200) is fitted to the upper end of the container (100) and has a passage for releasing the extinguishing medium (110) under a predetermined condition. The discharge nozzle (600) is fitted to one portion of the body (200) to communicate with the passage and discharges the extinguishing medium (110). The operating rod assembly (300) manually controls an opening of the passage by applying a predetermined external force or automatically controls an opening of the passage under a predetermined temperature condition e operating lever (400) is located at the other portion of the body (200) and applies the predetermined external force to the operating rod assembly (300). Therefore, the fire extinguisher is excellectly bearable to an external impact and economical.

16 Claims, 10 Drawing Sheets

FIRE EXTINGUISHER

TECHNICAL FIELD

This invention relates to fire extinguishers selectively operable either manually or automatically, and more particularly, to fire extinguishers selectively operable either manually or automatically which discharge fire extinguishing medium manually by an operation of a user and discharges it automatically at a predetermined temperature.

BACKGROUND ART

A fire extinguisher is used to extinguish a fire by ejection of a fire-inhibiting substance, such as water, carbon dioxide, gas, or chemical foam.

Fire extinguishers are basically classified into either a manual type fire extinguisher or an automatic type fire extinguisher. The manual type fire extinguisher extinguishes a fire by discharging a fire-inhibiting substance under pressure by an operation of a user. The automatic type fire extinguisher extinguishes a fire by detecting a fire automatically and discharging a fire-inhibiting substance under pressure automatically when a fire occurs.

The manual type fire extinguisher comprises a container for fire extinguishing medium stored under pressure, a main body having a valve assembly therein, and an operating lever to which a safety pin is fitted. A user removes the safety pin and then depresses the operating lever when a fire breaks out. Thus, the valve assembly is open and the fire extinguishing medium ejects from the container. However, if a fire breaks out when no one is there, such as at night, the manual type fire extinguisher can't function because a user needs to personally remove the safety pin to operate it.

The automatic type fire extinguisher comprises a container for fire extinguishing medium stored under pressure and a main body having a valve assembly having a heat sensing member. The heat sensing member detects a fire at the predetermined high temperature and then the valve assembly automatically opens. Thus, the fire extinguishing member ejects from the container. However, the heat sensing member can't detect a fire at a temperature below a reselected temperature and a user can't manually use the automatic fire extinguisher. Thus, there is a problem that the automatic fire extinguisher can't handle various fire situations.

To solve the above problems, it is disclosed in Korea Utility Publication No. 95-32294(14/12/1995) that a fire extinguisher selectively operable either manually or automatically is capable of being used manually or automatically per various situations.

FIG. 1 is a sectional view of the conventional fire extinguisher selectively operable either manually or automatically disclosed in Korea Utility Publication No. 95032294. Here, the reference number 10 is a cylindrical container for storing a fire extinguishing medium under pressure. The reference number 20 is a main body. The reference number 30 is a plunger installed in the main body. The reference number 40 is an operating lever for applying depressing force to the plunger. The reference number 50 is a handle. The reference number 60 is an automatic discharge nozzle portion for an automatic mode of the fire extinguisher. The reference number 70 is a hand-operated discharge nozzle for a manual mode. The reference number 11 is a fire extinguishing medium. The reference number 21 is a spring. The reference number 61 is a connecting pipe. The reference number 62 is a thermal sensor.

The above-mentioned conventional fire extinguisher selectively operable either manually or automatically is basically the same as the general manual type fire extinguisher except for the automatic discharge nozzle portion for ejecting the fire extinguishing medium automatically when a fire breaks out.

The overall operation is as follows.

If a user depresses the operating lever 40 when a fire breaks out, the plunger 30 moves downward. Thus, the hand-operated discharge nozzle 70 is open and the fire extinguishing medium 11 is discharged toward the fire. Meanwhile, if nobody is present at a fire place, the thermal sensor 62 detects a fire and then the automatic discharge nozzle portion automatically opens. Thus, the first extinguishing medium 11 is discharged automatically toward the fire through the connecting pipe 61.

The above-mentioned conventional fire extinguisher can handle a fire situation effectively since it operates manually, or automatically when no one is there, such as at night.

However, it's a bit inconvenient for a user to use it because the user needs to connect the automatic discharge nozzle portion 60 to the main body 20 and need to detach it from the main body 20. Thus the constructed conventional fire extinguisher has a major disadvantage that it can easily break by an external impact because the connecting pipe connected to one side of the main body 20 projects from the main body and is too long. Also, there is a disadvantage that a manufacturing cost is high because the automatic discharge nozzle portion 60 must be manufactured in a separate way.

Meanwhile, a fire extinguisher having a manual type valve and an automatic type valve is disclosed in U.K. Publication No. 2039735A.

As shown in FIG. 2, the fire extinguisher having a manual type valve and an automatic type valve is constructed of an ordinary manual type fire extinguisher having an ordinary manual type valve and an ordinary automatic type valve attached to a lower portion of the ordinary manual type fire extinguisher. Therefore, there is a disadvantage that a setting position is restricted and a manufacturing cost is high because the automatic type valve is separated from the manual type valve.

DETAILED DESCRIPTION OF THE INVENTION

In view of the prior art described above, including the disadvantages and deficiencies of the prior art, it is an object of the present invention to provide a fire extinguisher having an operating assembly therein selectively operable either manually or automatically.

The fire extinguisher selectively operable either manually or automatically according to the present invention comprises a container for fire extinguishing medium stored under pressure; a main body mounted at the upper portion of the container and having a passage for the fire extinguishing medium; a discharge nozzle projecting from one side of the main body and connected to the passage for discharging the fire extinguishing medium; an operating assembly movably located in the main body and biased by elastic means for controlling manually an opening of the passage by receiving a predetermined pressing force and for controlling automatically an opening the passage by an operation of a predetermined temperature; and an operating lever projecting from the other side of the main body for applying the predetermined pressing force to the operating assembly.

The operating assembly comprises an operator having a first bore made at the lower side thereof, a second bore made at side, and a second closure member and a first closure member protruding from an upper outer surface and a lower outer surface around the second bore respectively; a plunger slidably located in the operator to control opening and closing of the second bore; and a blocking cap attached to the upper portion of the operator to prevent the plunger from moving or to allow the plunger to move according to the predetermined temperature.

The operator has a plunger spring mounted therein for biasing the plunger and a plunger spring supporting portion protrudes inward from the end of the first bore for supporting the plunger spring. The operator may have at least one first sealing ring fitted between the operator and the main body to prevent leakage. The operator has a first stepped portion formed at an inner wall thereof between the first bore and the second bore, and the plunger has a second stepped portion to be in contact with the first stepped portion, for preventing the plunger from moving downward.

The plunger comprises a plunger body in the shape of cylinder; an operating portion extending from one end of the plunger body, having further reduced diameter than the plunger body, and being in contact with the blocking cap; and a supporting portion extending from the other end of the plunger body, having further reduced diameter than the plunger body, and being in contact with the plunger spring. The plunger body may have at least one second sealing ring fitted between the plunger and the operator to prevent leakage. The blocking cap may be a glass bulb to break when being heated to the predetermined temperature. The blocking cap may comprise a cap body engaging with the operator for preventing the plunger from springing out; a cap fitted into the cap body and being in contact with the plunger; and a thermal deformation member bonding normally the cap and the cap body for separating the cap from the cap body at the predetermined temperature. The cap body has a force receiving portion formed at the outer edge thereof for receiving pressing force from the operation lever; an opening made therein for receiving the plunger; and a blocking step formed around the lower end of the opening for preventing the plunger from springing out. The thermal deformation member may be Wood's metal melting when being heated to the predetermined temperature. The thermal deformation member may be a shape memory alloy that, after being deformed, can recover its original shape when it is heated.

The operating lever may have a lever opening in which an upper portion of the operating assembly is inserted.

The discharge nozzle may have a vortex generator for evaporating the liquid fire extinguishing medium and for discharging the evaporated fire extinguishing medium. The discharge nozzle may be a variable discharge nozzle capable of adjusting the discharging angle of the fire extinguishing medium.

The fire extinguisher selectively operable either manually or automatically according to the present invention further comprises a supporting member having at least one fixing hole for supporting the container, a fixing band fitted to the supporting member for fastening the container; and a fixing member inserted into the fixing hole for fixing the supporting member to a wall. The fixing band has a buckle assembly capable of adjusting the setting angle of the fire extinguisher.

It will be apparent that the invention, as described above, achieves a simple, compact, and economical fire extinguisher by the operation of the operating assembly having an improved configuration.

BEST MODE FOR CARRYING OUT THE INVENTION

Hereinafter, preferred embodiments according to the present invention will be described in detail with reference to the drawings.

Figure 1:
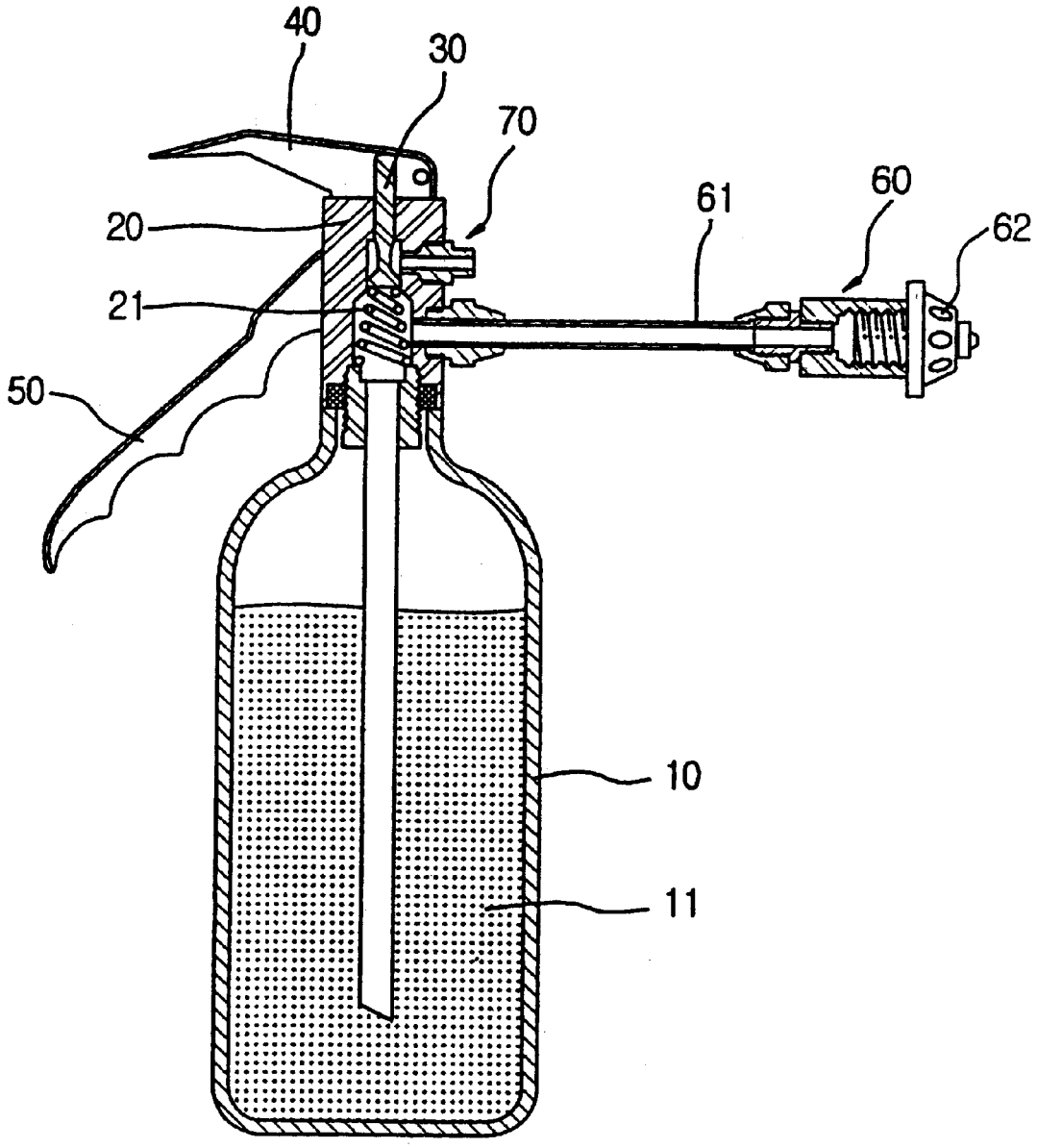
FIG. 1 PRIOR ART
FIG. 1 is a sectional view showing an embodiment of a conventional fire extinguisher selectively operable either manually or automatically.
Figure 2:
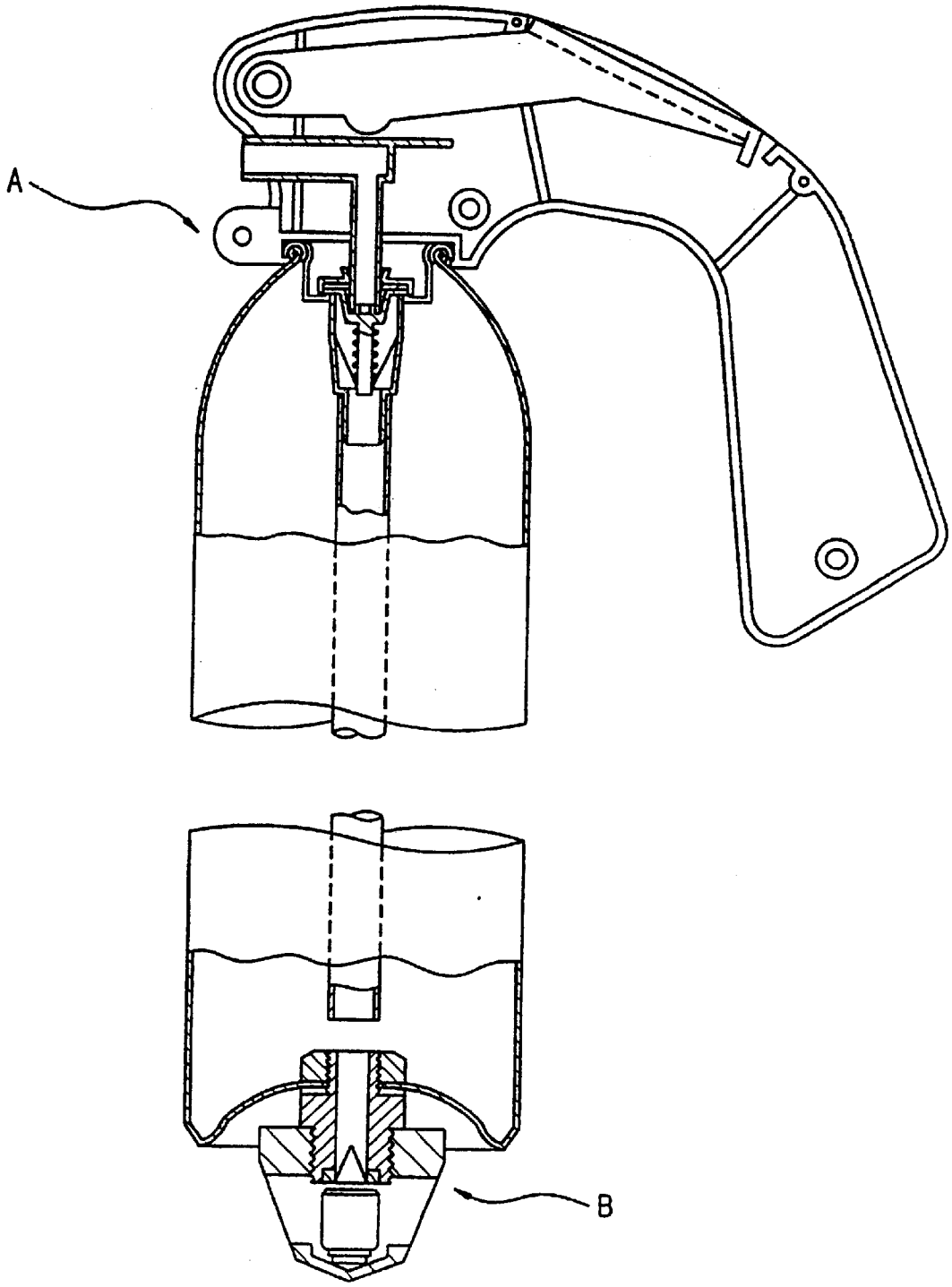
FIG.2 PRIOR ART
FIG. 2 is a sectional view showing another embodiment of a conventional fire extinguisher selectively operable either manually or automatically.
Figure 3:
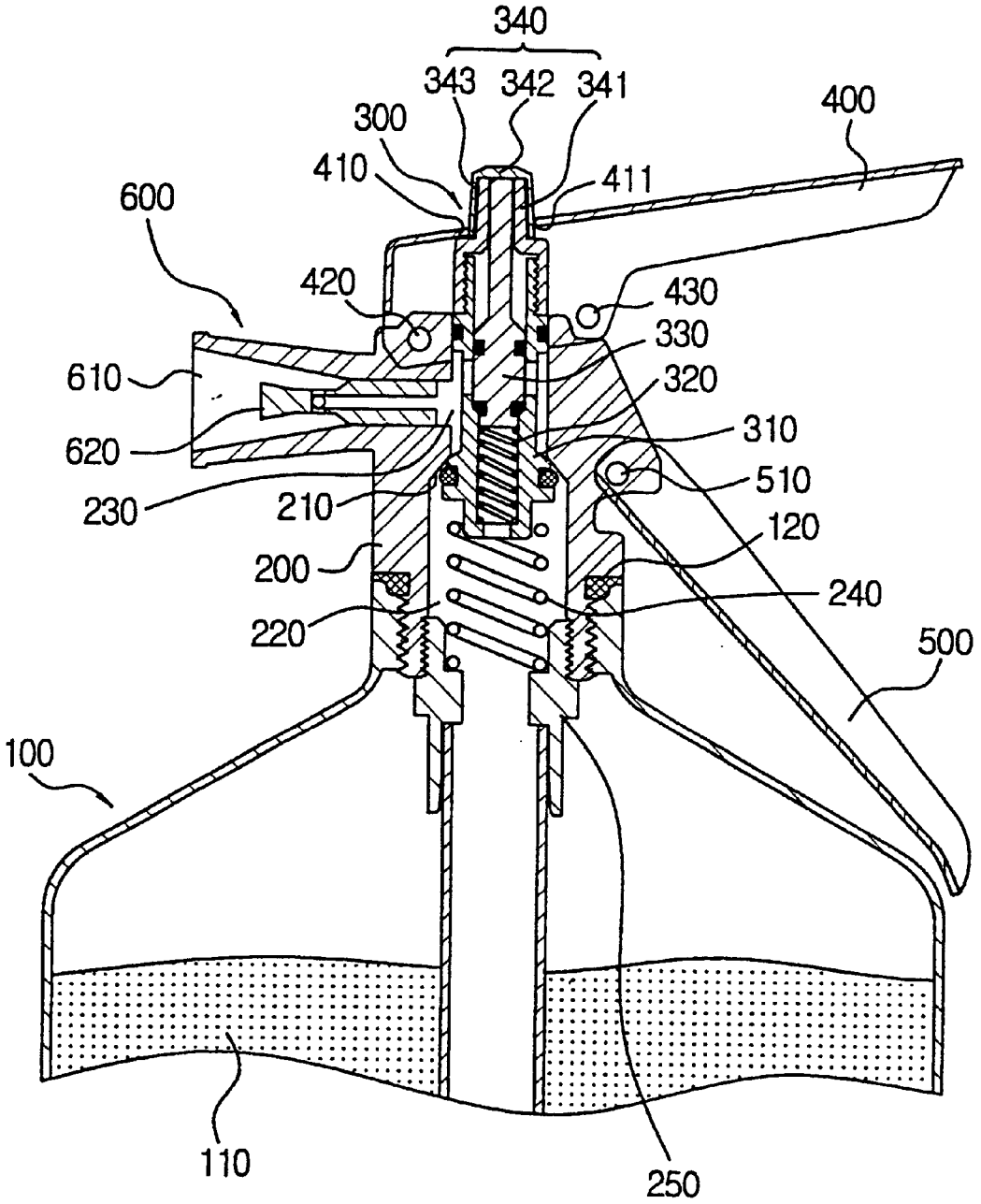
FIG. 3 is a vertical sectional view showing the configuration of a preferred embodiment of the fire extinguisher selectively operable either manually or automatically according to the present invention.

FIG. 3 is a vertical sectional view showing the configuration of a preferred embodiment of the fire extinguisher selectively operable either manually or automatically according to the present invention.

As shown in FIG. 3, the extinguisher according to the present invention comprises a container 100, a main body 200, an operating assembly 300, an operating lever 400, a handle 500, and a discharge nozzle 600.

Fire extinguishing medium 110 is stored in the container 100. The main body 200 is mounted at the upper portion of the container 100 to hold the elements of the fire extinguisher. A packing ring 120 is fitted between the container 100 and the main body 200 to prevent leakage.

The discharge nozzle 600 projects laterally from one side of the main body 200 and the handle 500 projects laterally from the other side of the main body 200. The operating assembly 300 is located inside the main body 200 and is biased to a limit position by an elastic means, such as an operating spring 240. The operating lever 400 is connected hingedly to the upper portion of the main body 200 by a hinge pin 420 and is normally restrained by a safety pin 430.

Hereinafter, the elements of the preferred embodiment according to the present invention will be described in detail.

The container 100 has enough strength not to rupture or fail due to the internal pressure therein. Fire extinguishing medium 110 stored in the container 100 is a fire-inhibiting substance, such as water, gas, or chemical foam.

The main body 200 has a first passageway 220 therein to accommodate the operating assembly 300 and a second passageway 230. A valve seat 210 protrudes inwardly in the first passageway 220. The first passageway 220 communicates with the container 100. An operating spring supporting member 250 is connected to the lower portion of the main body 200 to support the operating spring 240.

Figure 4:
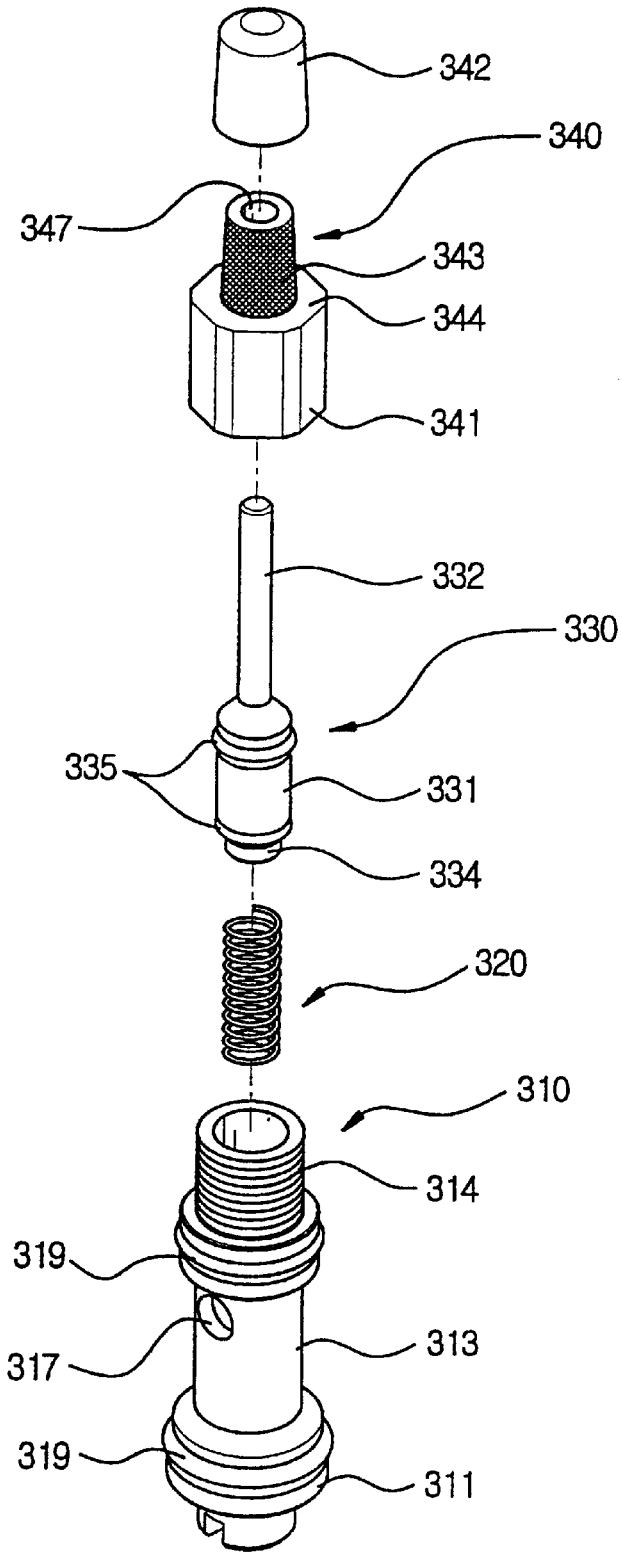
FIG. 4 is an exploded perspective view showing the operating assembly of the fire extinguisher shown in FIG. 3.
Figure 5:
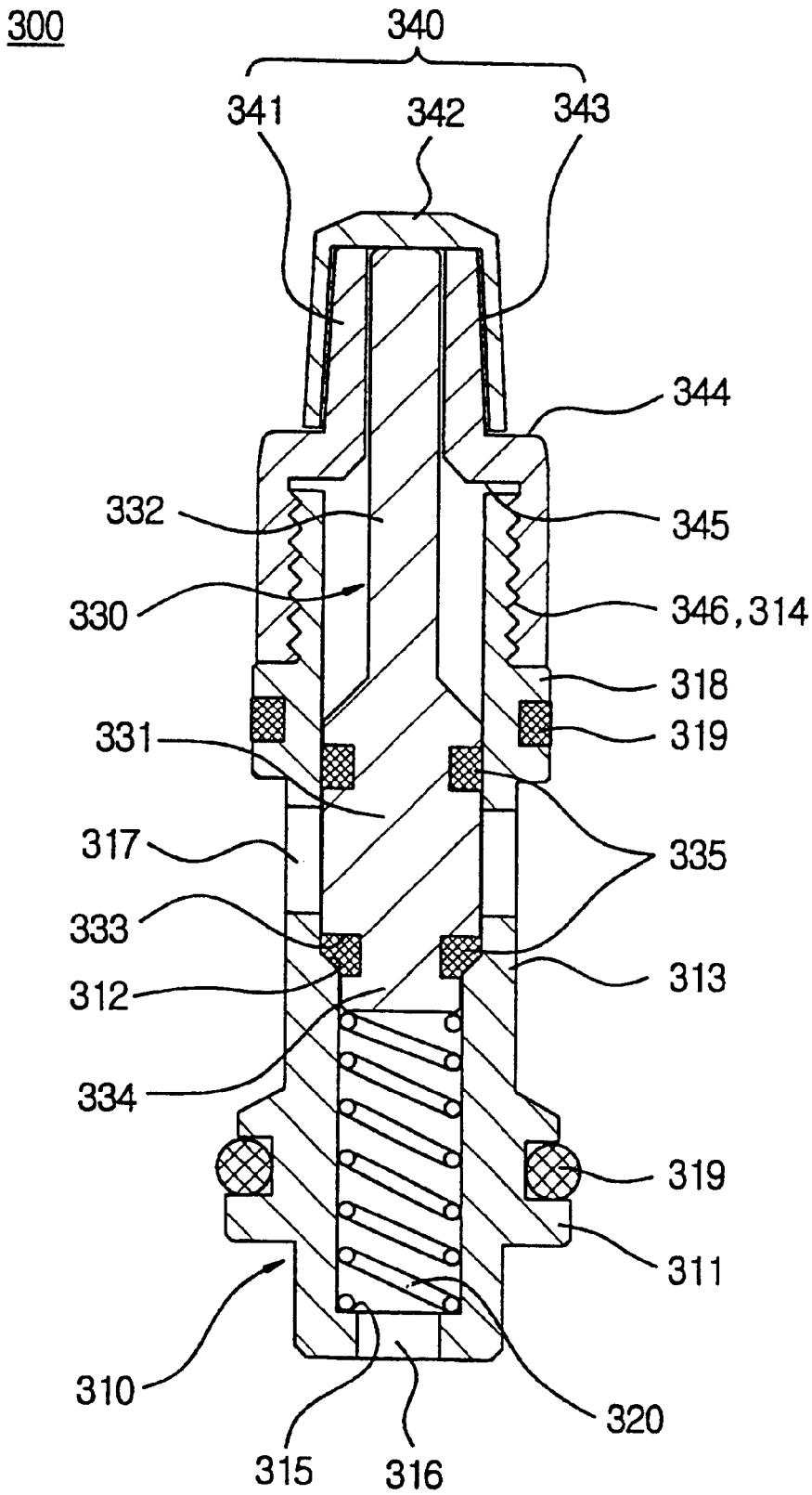
FIG. 5 is a vertical sectional view of the operating assembly of FIG. 4.

FIG. 4 is an exploded perspective view showing the operating assembly of the fire extinguisher shown in FIG. 3. FIG. 5 is a vertical sectional view of the operating assembly of FIG. 4.

As shown in FIG. 4 and FIG. 5, the operating assembly 300 comprises an operator 310, a plunger 330, a plunger spring 320, and a blocking cap 340.

The plunger 330 is located inside the operator 310 and is biased to a limit position by the plunger spring 320. The blocking cap 340 prevents the plunger 330 from springing out.

The operator 310 has a first bore 316 that is made at the lower side thereof to permit passage of the fire extinguishing medium 110 supplied from the container 100 in an automatic operation state. The operator 310 also has a second bore 317 that is made at the center portion of a stem portion 313 to supply the fire extinguishing medium 110 to the discharge nozzle 600 in an automatic operation state. The first bore 316 has a plunger spring supporting member 250 formed inside thereof to support the plunger spring 320. A first stepped portion 312 is formed at the inside below the second bore 317 to prevent the plunger 330 from moving downward.

A first closure member 311 protrudes below the stem portion 313 and engages with the valve seat 210, which opens or closes the first passageway 220. A second closure member 318 protrudes at the upside of the stem portion 313. The first closure member 311 and the second closure member 318 have at least one first sealing ring 319 to prevent leakage between the operator 310 and the main body 200.

The stem portion 313 and the operator 310 define a second passageway 230 that permits passage of the fire extinguishing medium 110 when the fire extinguisher operates automatically or manually. The second passageway 230 communicates with a discharge passageway 610 of the discharge nozzle 600. The operator 310 has an externally threaded portion 314 at the upper portion thereof in order to connect to the blocking cap 340.

The plunger 330 comprises a plunger body 331, an operating portion 332, and a supporting portion 334, and controls the opening and closing of the second bore 317.

The plunger body 331 is in the shape of cylinder and has at least one second sealing ring 335 fitted at the lower portion and the upper portion thereof respectively to prevent leakage between the plunger 330 and the operator 310. The operating portion 332 and the supporting portion:334 have further reduced diameter than the plunger body 331.

The upper end of the operating portion 332 is in contact with the blocking cap 340 and applies pressing force to the blocking cap 340 in an automatic operation state. The supporting portion 334 supports the plunger spring 32. The second stepped portion 333 is formed at the lower end of the plunger body 331 and engages with the first stepped portion 312 to prevent the plunger 330 from moving downward.

The blocking cap 340 comprises a cap body 341, a cap 342, and a thermal deformation member 343. The blocking cap 340 prevents the plunger from springing out.

The cap body 341 prevents the plunger from springing out perfectly in the automatic operation state and directly receives the pressing force applied from the operating lever 400 in the manual operation state. The cap body 341 has a force receiving portion 344 formed at the upper edge thereof for effectively receiving the pressing force from the operating lever 400 and has an opening 347 made at the inside thereof into which the operating portion 332 is inserted. The force receiving portion 344 directly receives the pressing force from a pressing portion 411, which is in contact therewith, formed at the operating lever 400. The cap body 341 also has a blocking step 345 formed around the lower end of the opening 347. The plunger body 331 engages with the blocking step 345 in the automatic operation state, and thus the plunger 330 is blocked by the blocking step 345 not to spring out.

The cap 342 is normally in contact with the operating portion 332 of the plunger 330 and projects outward through a lever opening of the operating lever 400.

The thermal deformation member 343 bonds normally the cap 342 and the cap body 340. If room temperature increases to a predetermined temperature due to a fire, the cap 342 is separated from the cap body 341 as the original shape of the thermal deformation member 343 is deformed. Thus, the plunger 330 pushes the cap 342 outward by an operation of the plunger spring 320 whereby the second bore 317 is open. The predetermined temperature is preferably 200 degrees to 240 degrees The thermal deformation member 343 is a material that changes its original shape at a predetermined temperature. The thermal deformation member 343 has enough strength not to rupture or fail due to the restoring force caused by the plunger spring 320.

The thermal deformation member 343 can be materials that break or melt. That is, a substance that its original shape changes at a predetermined temperature, such as a shape memory alloy, Wood's metal, etc., can be used for the thermal deformation member 343.

The shape memory alloy is an alloy that, after being deformed, can recover its original shape when it is heated. The shape memory alloy may contains titanium-nickel alloy or aluminum alloy, etc.

The Wood's metal is a fusible alloy of the Cerro Corporation that contains 14% tin, 12% cadmium, 24% lead and 50% bismuth. The melting point of the wood's metal is capable of being regulated by changing the rate of the component thereof.

Meanwhile, the blocking cap 340 can be a glass bulb which breaks when being heated to the predetermined temperature. The glass bulb contains glass and may have alcohol therein. The glass bulb has enough strength not to rupture below a predetermined operating temperature, preferably between 200 degrees Celsius and 240 degrees Celsius, and ruptures or fails due to the internal force therein.

When the gals bulb is used as the thermal deformation member 343, the operating portion 332 of the plunger 330 is preferably removed. The glass bulb is installed at the upper portion of the plunger body 331 without the operating portion 332 in contact with each other.

The shape memory metal can be recycled, but the Wood's metal, the glass bulb etc. should be substituted for another after being used once.

Figure 8:
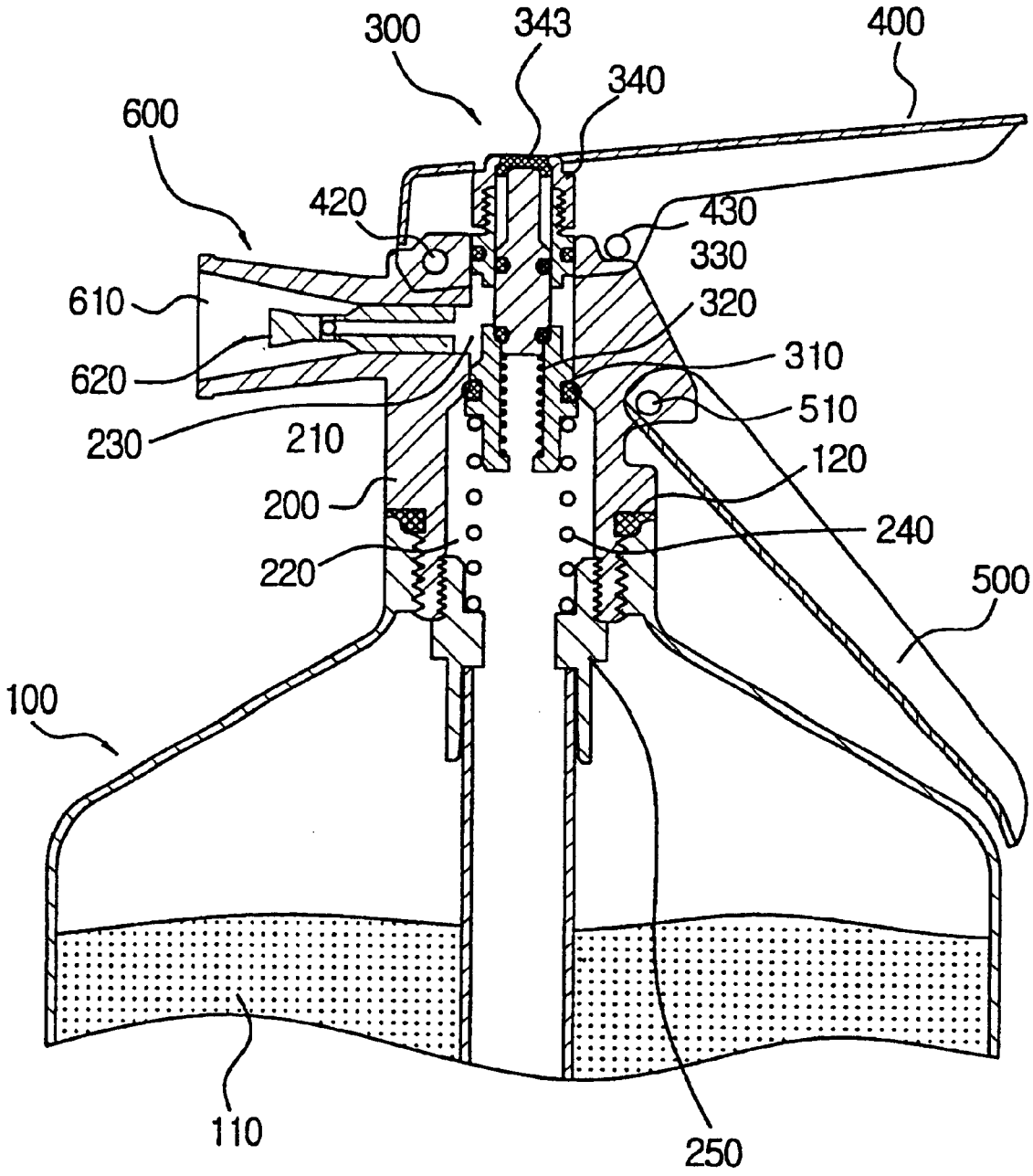
FIG. 8 is a vertical sectional view showing the configuration of another preferred embodiment of the fire extinguisher selectively operable either manually or automatically according to the present invention.

FIG. 8 is a vertical sectional view showing the configuration of another preferred embodiment of the fire extinguisher selectively operable either manually or automatically according to the present invention.

As shown in FIG. 8, the blocking cap 340 can be substituted for the thermal deformation member 343. At this time, the thermal deformation member 343 has enough strength not to rupture or fail due to the restoring force caused by the plunger spring 320 below the predetermined temperature.

Meanwhile, as shown in FIG. 3, the operating lever 400 applies the pressing force to the operating assembly 300 in manual operation state. The operating lever 400 is connected hingedly to the upper portion of the main body 200 by a hinge pin 420 and is normally restrained by a safety pin 430. The operating lever 400 has the lever opening 410. The blocking cap 340 is normally inserted into the lever opening 410. When user depresses the operating lever 400 in manual operation state, pressing force is transmitted to the force receiving portion 344 of the cap body 341 through the pressing portion 411 around the lever opening 410.

The handle 500 is connected hingedly to a portion of the main body 200 under the operating lever 400 by a handle hinge pin 510.

The discharge nozzle 600 is connected to the main body 200 and projects laterally forward. The fire extinguishing medium 110 is discharged through the discharge nozzle 600. The discharge passageway 610 communicating with the second passageway 230 is made inside the discharge nozzle 600. A vortex generator 620 is installed inside the discharge nozzle 600 to evaporate the liquid fire extinguishing medium 110 and discharge the evaporated fire extinguishing medium 110. That is, the vortex generator 620 is a tubelike device for accelerating and evaporating the fire extinguishing medium 110, whose pressure decreases as it leave the vortex generator 620. The vortex generator 620 improves the fire extinguishing performance of the fire extinguisher.

Figure 9:
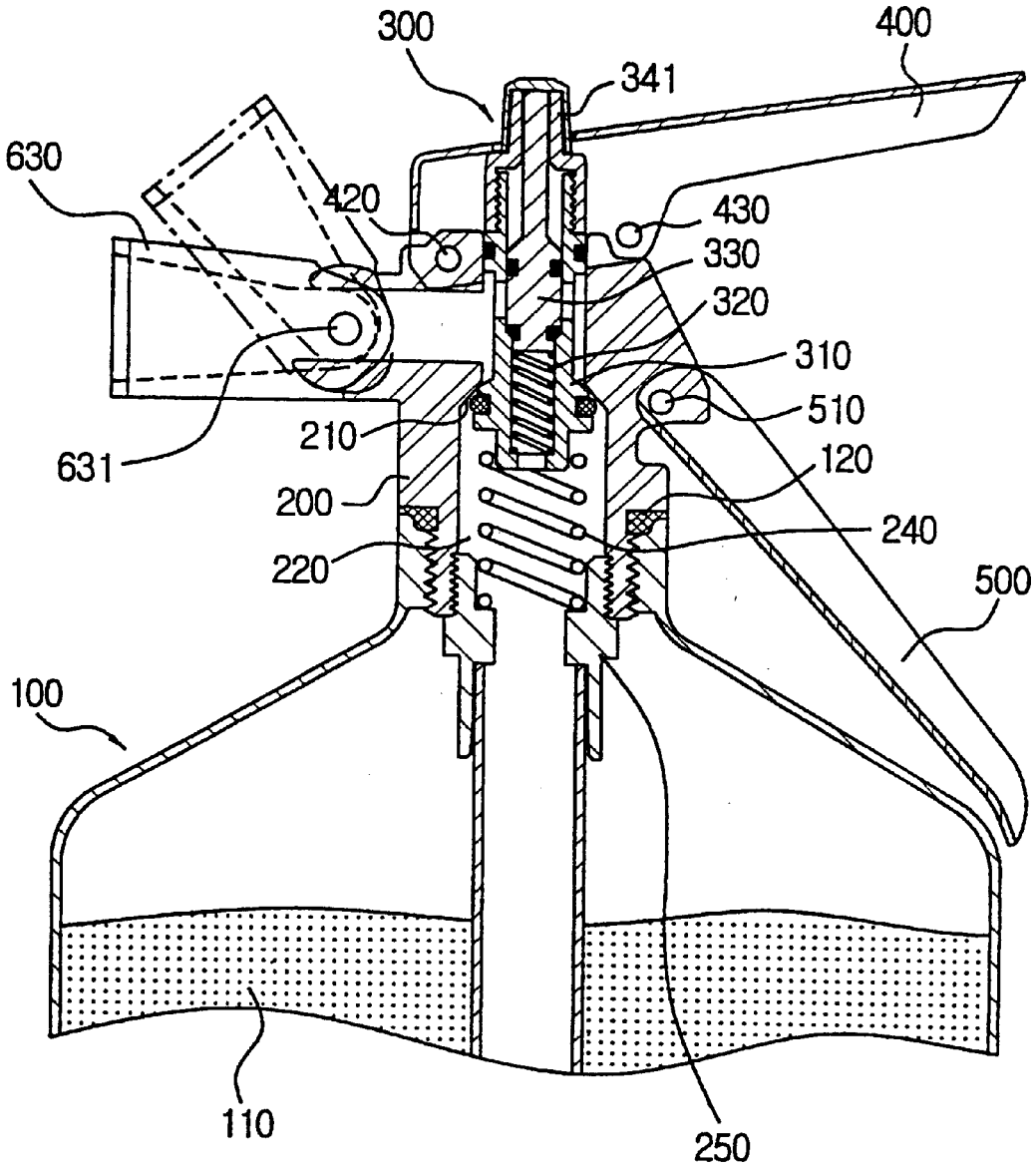
FIG. 9 is a vertical sectional view showing the configuration of the fire extinguisher having the variable discharge nozzle according to the present invention.

FIG. 9 is a vertical sectional view showing the configuration of the fire extinguisher having the variable discharge nozzle according to the present invention.

As shown in FIG. 9, the discharge nozzle 600 can be a variable discharge nozzle 630 capable of adjusting the discharging angle of the fire extinguishing medium 110.

The fire extinguisher according to the present invention should preferably have the variable discharge nozzle 630 capable of adjusting the discharging angle of the fire extinguishing medium 110 differently from a conventional manual type fire extinguisher because it also operates when on one is there. The discharging angle of the variable discharge nozzle 630 is preferably adjusted to point toward an expected area where a fire may break out.

The variable discharge nozzle 630 can be connected hingedly to the main body 200 in a vertical manner by an adjusting pin 631. The variable discharge nozzle 630 also can be connected hingedly to the main body 200 in a horizontal manner.

Figure 10:
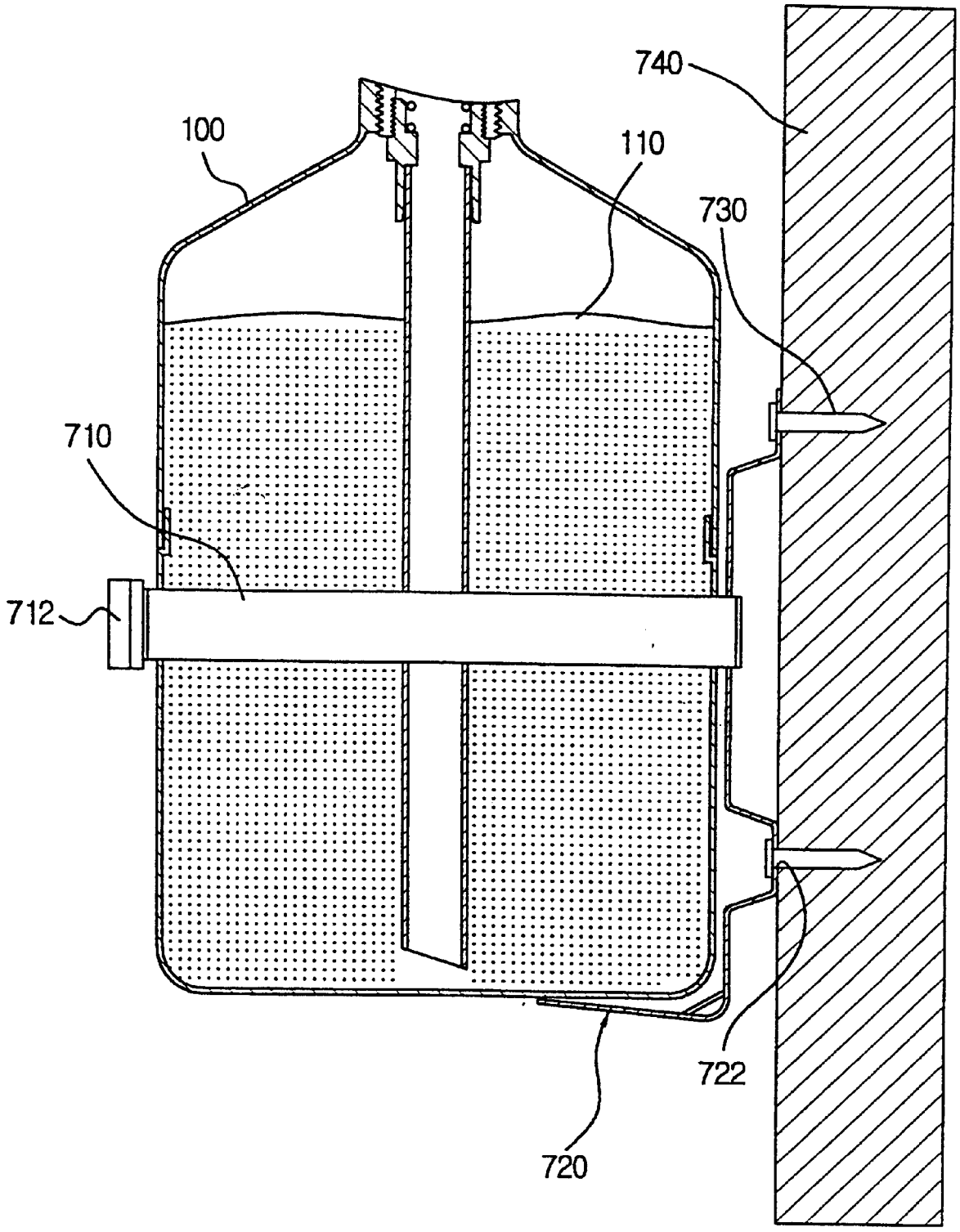
FIG. 10 is a vertical sectional view showing an preferred embodiment of the fixing means of the fire extinguisher shown in FIG. 3.

FIG. 10 is a vertical sectional view showing a preferred embodiment of the fixing means of the fire extinguisher shown in FIG. 3.

The fire extinguisher of the present invention may comprise fixing means 700 to fix it on a wall, etc. The fixing means 700 comprise a fixing member 730, a supporting member 720 and a fixing band 710. The fixing band 710 may comprise a buckle assembly 712 capable of adjusting the setting angle of the fire extinguisher.

The supporting member 720 is fixed to a wall using the fixing member 730, such as nails, screws, pins, etc. The supporting member 720 is bent in a corresponding shape of the container 100 to support the container 100. The supporting member 720 has at least one fixing hole 722. The fixing member 730 is inserted into the fixing hole 722. The fixing bend 710 fixes the container 100 to the supporting member 720 at a suitable setting angle by an operation of the buckle assembly.

Meanwhile, the fire extinguisher according to the present invention may comprise a pressure gauge (not shown) to measure an amount of the residual fire extinguishing medium 110 stored in the container 100.

The overall operation is as follows.

Figure 6:
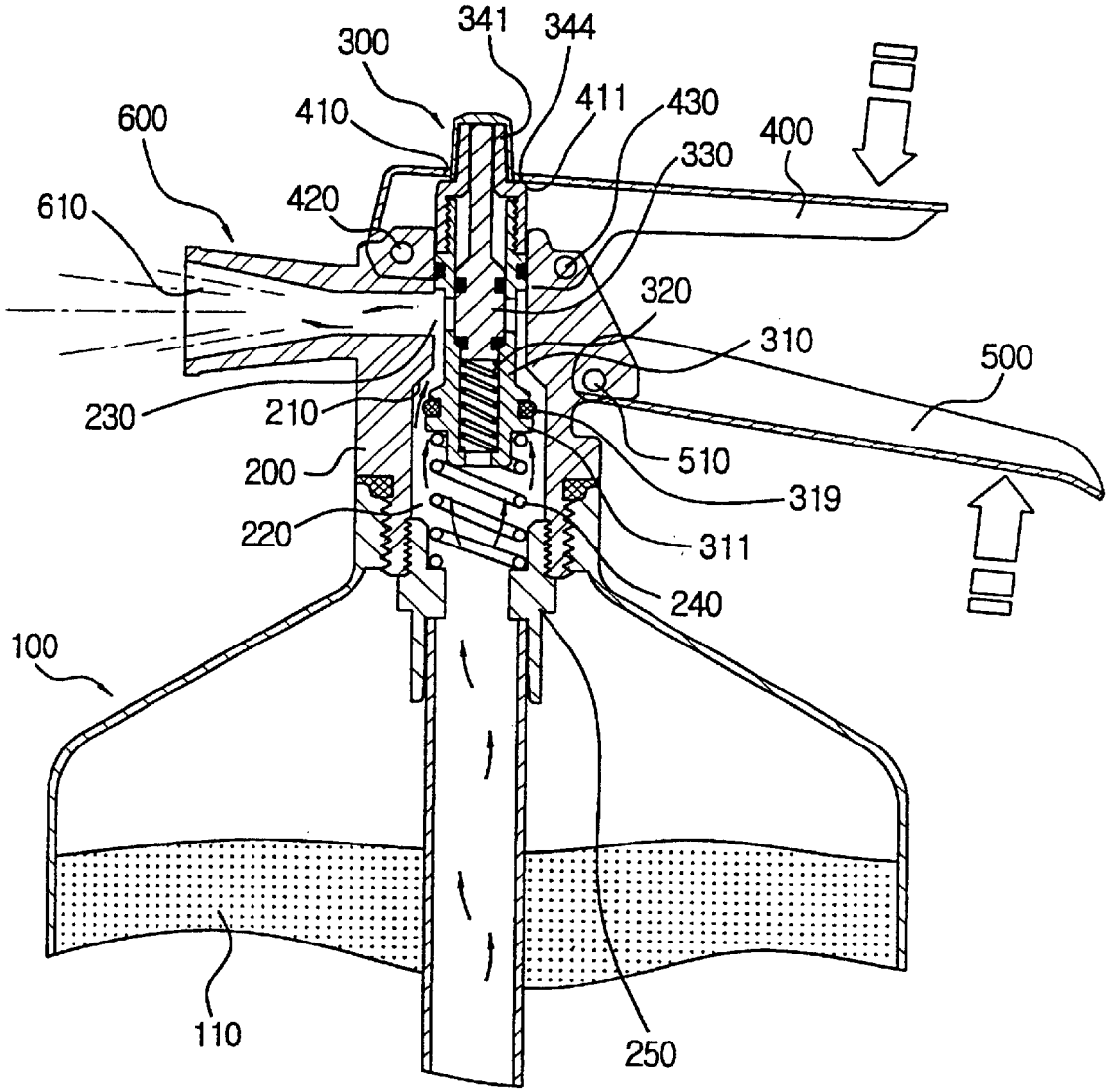
FIG. 6 is a vertical sectional view showing the operational state in a manual type of the fire extinguisher shown in FIG. 3.
Figure 7:
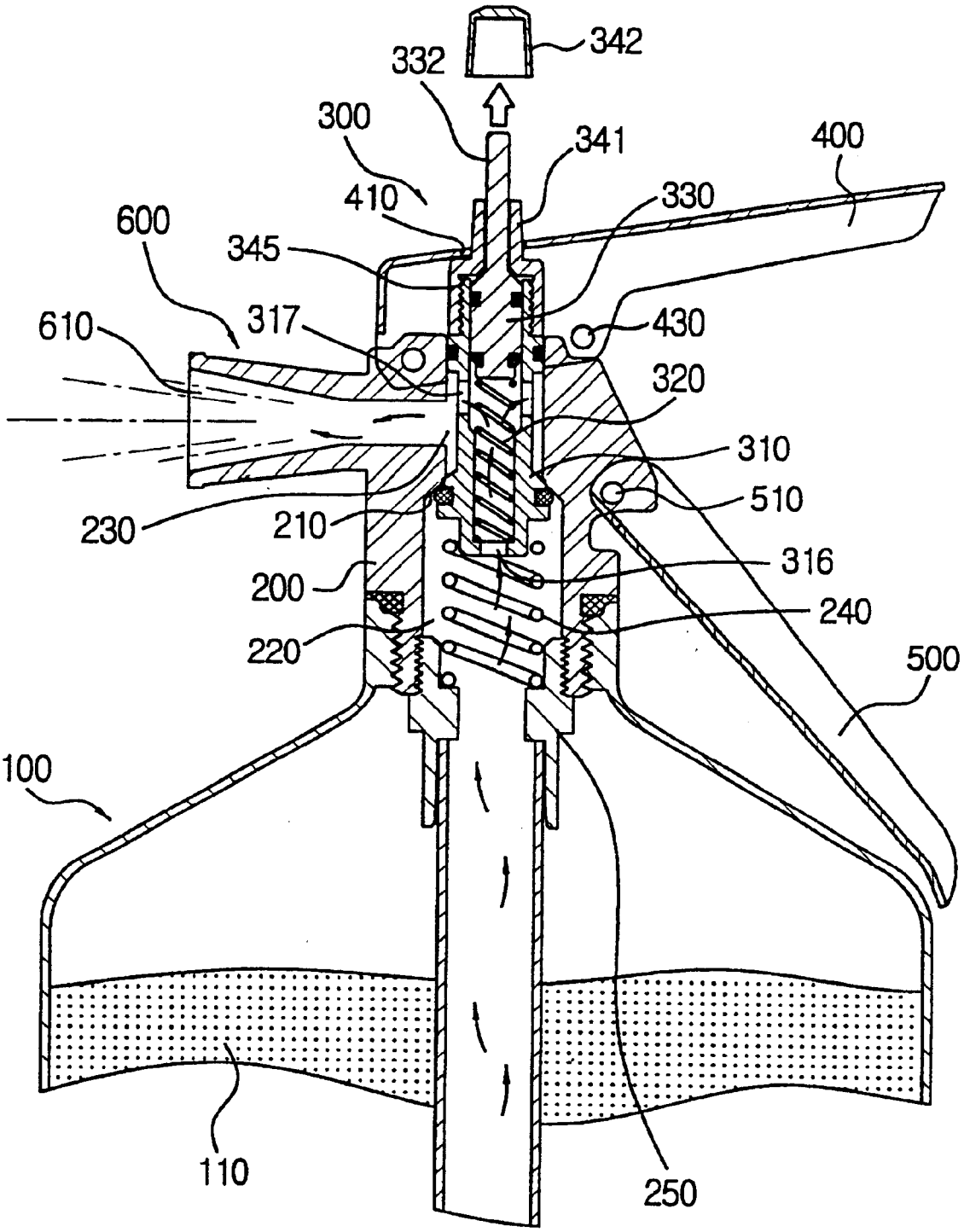
FIG. 7 is a vertical sectional view showing the operational state in an automatic type of the fire extinguisher shown in FIG. 3.

FIG. 6 is a vertical sectional view showing the operational state in a manual type of the fire extinguisher according to the present invention. FIG. 7 is a vertical sectional view showing the operational state in a automatic type of the fire extinguisher according to the present invention.

The operational state in a manual type is described at first.

As shown in FIG. 6, user removes the safety pin 430 from the operating lever 400 and then depresses the operating lever 400 whereby it rotates downward about the hinge pin 420. Thus, the pressing portion 411 of the operating lever 400 depresses the force receiving portion 344 of the cap body 341 and then the operator 310 moves down.

When the operator 310 moves down, the first closure member 311 is separates from the valve seat 210 whereby the fire extinguishing medium 110 is discharged outward via the first passageway 220, the second passageway 230 and the discharge nozzle 600 successively.

The overall discharging route of the fire extinguishing medium 110 in the manual type is as follows. The fire extinguishing medium 100 moves via the container 100, the first passageway 220, the space between the valve seat 210 and the first closure member 311, the second passageway 230 and the discharge passageway 610 successively.

Hereinafter, the operational state in an automatic type is described.

The thermal deformation member 343 normally prevents the plunger 330 from moving at room temperature.

The melting point of the thermal deformation member 343 can be predetermined. The predetermined melting temperature is preferably between 200 degrees Celsius and 240 degrees Celsius.

As shown in FIG. 7, if the temperature of the thermal deformation member 343 reaches the predetermined temperature, its original shape is deformed or it melts. Thus, the cap 342 is separated from the cap body 341 and then the cap 342 can't block the plunger 330. That is, the operating portion 332 of the plunger 330 pushes the cap 342 and then protrudes from the:upper part of the cap body 341 due to restoring force of the plunger spring 320. The plunger 330 springs out upward immediately. At this time, the blocking step 345 prevents the plunger 330 from completely springing out.

If the plunger 330 moves upward, the second bore 317 is open. The overall discharging route of the fire extinguishing medium 110 in the automatic type is as follows. The fire extinguishing medium 100 moves via the container 100, the first passageway 220, the first bore 316, the second bore 317, the second passageway 230 and the discharge passageway 610 successively.

Meanwhile, user fixes the fire extinguisher according to the present invention to a wall using the fixing means 700 so that the discharge nozzle 600 points toward an expected area where a fire may break out. If user uses the variable discharge nozzle 630 there, he can extinguish the fire effectively. At this time, the variable discharge nozzle 630 points preferably toward the ceiling of a room so that the fire extinguishing medium 110 is spread over a large area by a reflection thereof, thus a fire extinguishing performance is advanced.

The fire extinguisher according to this present invention can be installed at an infinite variable setting angle thereof by using the buckle assembly 712 of the fixing band 710.

The effects of the fire extinguisher according to the invention as described above is as follows. The fire extinguisher according to the present invention can effectively handle various fire situations because it can be operated in the manual type if a fire breaks out when someone is there and operated in the automatic type if a fire breaks out when no one is there, such as at night. Therefore, the fire extinguisher according to the present invention can be used in a building, a factory that manufactures combustibles, a vehicle etc. to put out a fire.

The fire extinguisher according to the present invention doesn't easily break by an external impact and the manufacturing cost thereof is low because it has the operating assembly installed therein which is a single body capable of operating manually or automatically. Also, the fire extinguisher according to the present invention may be set anywhere and the configuration thereof is compact because the fire extinguishing medium is discharged from one discharge nozzle independently of the operation state, the manual type operation state or the automatic type operation state.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A fire extinguisher selectively operable either manually or automatically comprising:

a container for storing fire extinguishing medium under pressure;

a main body mounted at an upper portion of the container and having a passage for the fire extinguishing medium;

a discharge nozzle projecting from one side of the main body and connected to the passage for discharging the fire extinguishing medium;

an operating assembly movably located in the main body and biased by elastic means for controlling manually an opening of the passage by receiving pressing force and for controlling automatically an opening of the passage by an operation of a predetermined temperature, the operating assembly including:

an operator having a first bore made at the lower side thereof, a second bore made at the vertical sidewall thereof, and a second closure member and a first closure member protruding from an upper outer surface and a lower outer surface around the second bore respectively;

a plunger slidably located in the operator to control opening and closing of the second bore; and a blocking cap attached to the upper portion of the operator to prevent the plunger from moving or to allow the plunger to move according to the predetermined temperature; and an operating lever projecting from the other side of the main body for applying the pressing force to the operating assembly.

2. The fire extinguisher selectively operable either manually or automatically according to claim 1, wherein the discharge nozzle is a variable discharge nozzle capable of adjusting the discharging angle of the fire extinguishing medium.

3. The fire extinguisher selectively operable either manually or automatically according to claim 1, wherein the operator has a plunger spring mounted therein for biasing the plunger and a plunger spring supporting portion protrudes inward from the end of the first bore supporting the plunger spring.

4. The fire extinguisher selectively operable either manually or automatically according to claim 1, wherein the operator has at least one first sealing ring fitted between the operator and the main body to prevent leakage.

5. The fire extinguisher selectively operable either manually or automatically according to claim 1, wherein the operator has a first stepped portion formed at an inner wall thereof between the first bore and the second bore, and the plunger has a second stepped portion to be in contact with the first stepped portion, for preventing the plunger from moving downward.

6. The fire extinguisher selectively operable either manually or automatically according to claim 1, wherein the plunger comprises:

a plunger body in the shape of cylinder;

an operating portion extending from one end of the plunger body, having further reduced diameter than the plunger body, and being in contact with the blocking cap; and a supporting portion extending from the other end of the plunger body, having further reduced diameter than the plunger body, and being in contact with the plunger spring.

7. The fire extinguisher selectively operable either manually or automatically according to claim 6, wherein the plunger body has at least one second sealing ring fitted between the plunger and the operator to prevent leakage.

8. The fire extinguisher selectively operable either manually or automatically according to claim 1, wherein the blocking cap is a glass bulb which breaks when being heated to the predetermined temperature.

9. The fire extinguisher selectively operable either manually or automatically according to claim 1, wherein the blocking cap comprises:

a cap body engaging with the operator for preventing the plunger from springing out;

a cap fitted into the cap body and being in contact with the plunger; and a thermal deformation member bonding the cap and the cap body normally for separating the cap from the cap body at the predetermined temperature.

10. The fire extinguisher selectively operable either manually or automatically according to claim 9, wherein the cap body has:

a force receiving portion formed at the outer edge thereof for receiving pressing force from the operator lever;

an opening made therein for receiving the plunger; and a blocking step formed around the lower end of the opening for preventing the plunger from springing out.

11. The fire extinguisher selectively operable either manually or automatically according to claim 9, wherein the thermal deformation member is Wood's metal melting when being heated to the predetermined temperature.

12. The fire extinguisher selectively operable either manually or automatically according to claim 9, wherein the thermal deformation member is a shape memory alloy that, after being deformed, can recover its original shape when it is heated.

13. The fire extinguisher selectively operable either manually or automatically according to claim 1, wherein the operating lever has a lever opening in which an upper portion of the operating assembly is inserted.

14. The fire extinguisher selectively operable either manually or automatically according to claim 1, wherein the discharge nozzle has a vortex generator for evaporating the liquid fire extinguishing medium and discharging the evaporated fire extinguishing medium.

15. The fire extinguisher selectively operable either manually or automatically according to claim 2, further comprising:

a supporting member having at least one fixing hole for supporting the container;

a fixing band fitted to the supporting member for fastening the container; and a fixing member inserted into the fixing hole for fixing the supporting member to a wall.

16. The fire extinguisher selectively operable either manually or automatically according to claim 15, wherein the fixing band has a buckle assembly capable of adjusting the setting angle of the fire extinguisher.

* * * * *